US007890010B2

(12) United States Patent
Kikuchi

(10) Patent No.: US 7,890,010 B2
(45) **Date of Patent: *Feb. 15, 2011**

(54) FIXING DEVICE FOR COLOR IMAGE FORMING APPARATUS AND CONTROL METHOD

(75) Inventor: Kazuhiko Kikuchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/686,658

(22) Filed: Jan. 13, 2010

(65) Prior Publication Data

US 2010/0111555 A1 May 6, 2010

Related U.S. Application Data

(63) Continuation of application No. 12/191,520, filed on Aug. 14, 2008, now Pat. No. 7,676,168, which is a continuation of application No. 11/440,654, filed on May 24, 2006, now Pat. No. 7,428,389.

(51) Int. Cl.
*G03G 15/20* (2006.01)

(52) U.S. Cl. ..... 399/69; 219/216

(58) Field of Classification Search ..... 399/69, 399/70, 67, 88, 33, 37; 219/216, 619; 347/156; 430/124.1, 124.3

See application file for complete search history.

(56) References Cited

U.S. PATENT DOCUMENTS

| | | | | |
|---|---|---|---|---|
| 7,035,581 | B2 * | 4/2006 | Cho et al. | 399/328 X |
| 7,676,168 | B2 * | 3/2010 | Kikuchi | 399/69 |
| 2006/0067721 | A1 * | 3/2006 | Fujisawa | 399/69 |

* cited by examiner

*Primary Examiner*—Sophia S Chen
(74) *Attorney, Agent, or Firm*—Turocy & Watson, LLP

(57) ABSTRACT

A fixing device switches ON a heater lamp of the press roller in a fixing device in a color print mode. In a monochromatic mode, power comparable to the power consumption of the heater lamp can be supplied additionally to an exciting coil on the heat roller side when a heater lamp 3 stays OFF. An amount needed for the heat roller can be therefore added flexibly to the exciting coil. During a warm-up, power comparable to power consumption of the option can be supplied additionally to the exciting coil on the heat roller side.

17 Claims, 7 Drawing Sheets

| | HEAT SOURCE | OUTPUT | COLOR MODE | MONOCHROMATIC MODE |
|---|---|---|---|---|
| HEAT ROLLER | FIRST COIL | 600～1300W | ON | ON |
| | SECOND COILS | 600～1300W | ON | ON |
| PRESS ROLLER | HEATER LAMP | 300W | ON | OFF |

FIG.5

| | COLOR MODE | MONOCHROMATIC MODE | | | | | WARM-UP |
|---|---|---|---|---|---|---|---|
| H/R TEMPERATURE | - | 180 | 180 | 180 | 170 | 160 | - |
| P/R TEMPERATURE | - | 100-145℃ | 80-100℃ | 80℃ OR BELOW | 80-100℃ | 80-100℃ | - |
| IH POWER | 600W | 600W | 700W | 600W | 800W | 900W | 1000W |
| LAMP POWER | 300W | OFF | OFF | 300W | OFF | OFF | 300W |

FIG.8

| | COLOR MODE | MONOCHROMATIC MODE | | | | | WARM-UP |
|---|---|---|---|---|---|---|---|
| H/R TEMPERATURE | – | 180°C | 180°C | 180°C | 170°C | 160°C | – |
| P/R TEMPERATURE | – | 100–145°C | 80–100°C | 80°C OR BELOW | 80–100°C | 80–100°C | – |
| IH POWER | 900W | 900W | 1000W | 900W | 1100W | 1200W | 1000W |
| LAMP POWER | 300W | OFF | OFF | 300W | OFF | OFF | 300W |

FIG.9

FIXING DEVICE FOR COLOR IMAGE FORMING APPARATUS AND CONTROL METHOD

CROSS-REFERENCE TO RELATED APPLICATIONS

This application claims the benefit of priority from and is a Continuation of application Ser. No. 12/191,520 filed on Aug. 14, 2008, which claims the benefit of priority from and is a Continuation of application Ser. No. 11/440,654 filed on May 24, 2006, the entire contents of both of which are incorporated herein by reference.

FIELD OF THE INVENTION

The present invention relates to a fixing device for a color image forming apparatus to fix a toner image formed by an image forming apparatus using an electro-photographic process, such as a copying machine, a printer, and a facsimile machine, onto a sheet of paper by heating and pressing and to a control method thereof.

DESCRIPTION OF THE BACKGROUND

There is a fixing device that fixes a toner image on a sheet of paper by heating and pressing as a fixing device incorporated into an image forming apparatus using an electro-photographic process, such as a copying machine, a facsimile machine, and a printer. Such a fixing device fixes a toner image by heating and pressing by inserting a sheet of paper through a nip formed between a pair of rollers comprising a heat roller and a press roller or between belts of the same kinds. Meanwhile, a full color toner image formed by superimposing toner images of plural colors has a toner layer several times thicker than that of a monochromatic toner image. With this being the case, generally, when a monochromatic toner image is fixed, only the heat roller that comes into contact with the toner image is heated without heating the press roller. On the other hand, when a full color toner image is fixed, both the press roller that supports the back surface of a sheet of paper and the heat roller that comes into contact with the toner image are heated.

In other words, when a color toner image is fixed, power is supplied to both the heat roller and the press roller whereas power is supplied to the heat roller alone when a monochromatic toner image is fixed. With this being the situation, there has been a device that supplies, when a monochromatic toner image fixed, the heat roller with power increased by an amount comparable to the power that is supplied to the press roller when a color toner image is fixed. This device in the related art shortens a warm-up time by increasing power to be supplied to the heat roller when a monochromatic toner image is fixed, and it further increases a speed when a monochromatic toner image is fixed by keeping a desired fixing temperature even when fixing is performed successively. In addition, when a full color toner image is fixed, it heats the bottom layer of a toner image by supplying power to the press roller and thereby achieves a satisfactory fixing performance.

The fixing device in the related art, however, uses a heater lamp as a heat source of the heat roller and the press roller. For such a heater lamp, power consumption is normally determined by the heater lamp. Hence, in a case where an amount of power used for the heater of the press roller is added to the power on the heat roller side, a warm-up heater lamp is actually added on the heat roller side. Moreover, in order to keep a constant temperature on the surface of the heat roller, plural heater lamps need to be disposed at regular intervals. This makes it difficult to achieve a size reduction of the heat roller.

Meanwhile, a total amount of power that can be used for the entire color image forming apparatus is fixed to 1500 W. The amount of power actually available for a heat source of the fixing device is therefore found to be a remaining amount of power, which is a remainder when an amount of power used for the driving source, such as motors, and an amount of power used for optional functions, such as finisher, are subtracted from 1500 W. Moreover, power consumption of the heat source of the fixing device is set so that the fixing device can be incorporated into an apparatus in which the power of the driving source and the power consumption of the optional function are set at a maximum.

In a case where the fixing device is incorporated into a color image forming apparatus that is not furnished with optional functions or has a small driving source, power consumption available for the heat source can be increased further. In such a case, however, power consumption of the heater lamp cannot be adjusted freely.

Under these circumstances, there has been a need for a fixing device for a color image forming apparatus not only capable of enhancing the fixing performance when a color toner image is fixed, but also capable of enhancing the fixing productivity when a monochromatic toner image is fixed by controlling the heat source of the fixing device at a higher degree of flexibility to match with the structure of the color image forming apparatus or image forming conditions, and a control method of the fixing device for a color image forming apparatus.

SUMMARY OF THE INVENTION

The invention therefore achieves a satisfactory fixing performance for a color toner image having a thick toner layer by heating the bottom layer of the toner image sufficiently. Also, the invention provides a fixing device for a color image forming apparatus capable of enhancing the productivity resulting from enhancement of the fixing efficiency for a monochromatic toner image by increasing an amount of power for the heat roller and thereby shortening a warm-up time and increasing a fixing speed, and a control method of the fixing device.

In order to achieve the advantage described above, a fixing device for a color image forming apparatus according to one embodiment of the invention is characterized by including: a rotating member on an image side having a conductive heat generating layer; an induction current generating member that causes the heat generating layer to induce an induction current; a rotating member not on an image side that transports a fixed medium bearing a toner image in a certain direction by pinching the fixed medium together with the rotating member on the image side; a heating source that heats the rotating member not on the image side; and a control unit configured to control the heating source to reduce power consumption and enables power comparable to the reduced power consumption to be applied additionally to the induction current generating member.

BRIEF DESCRIPTION OF THE DRAWINGS

FIG. 5 is a table showing ON/OFF control on an exciting coil and a heater lamp in a color mode and in a monochromatic mode according to one embodiment of the invention;

FIG. 8 is a table showing power control on the exciting coil and the heater lamp in a monochromatic mode when the apparatus is furnished with an option according to one embodiment of the invention; and FIG. 9 is a table showing power control on the exciting coil and the heater lamp in a monochromatic mode when the apparatus is not furnished with an option according to one embodiment of the invention.

DETAILED DESCRIPTION OF THE INVENTION

Figure 1:
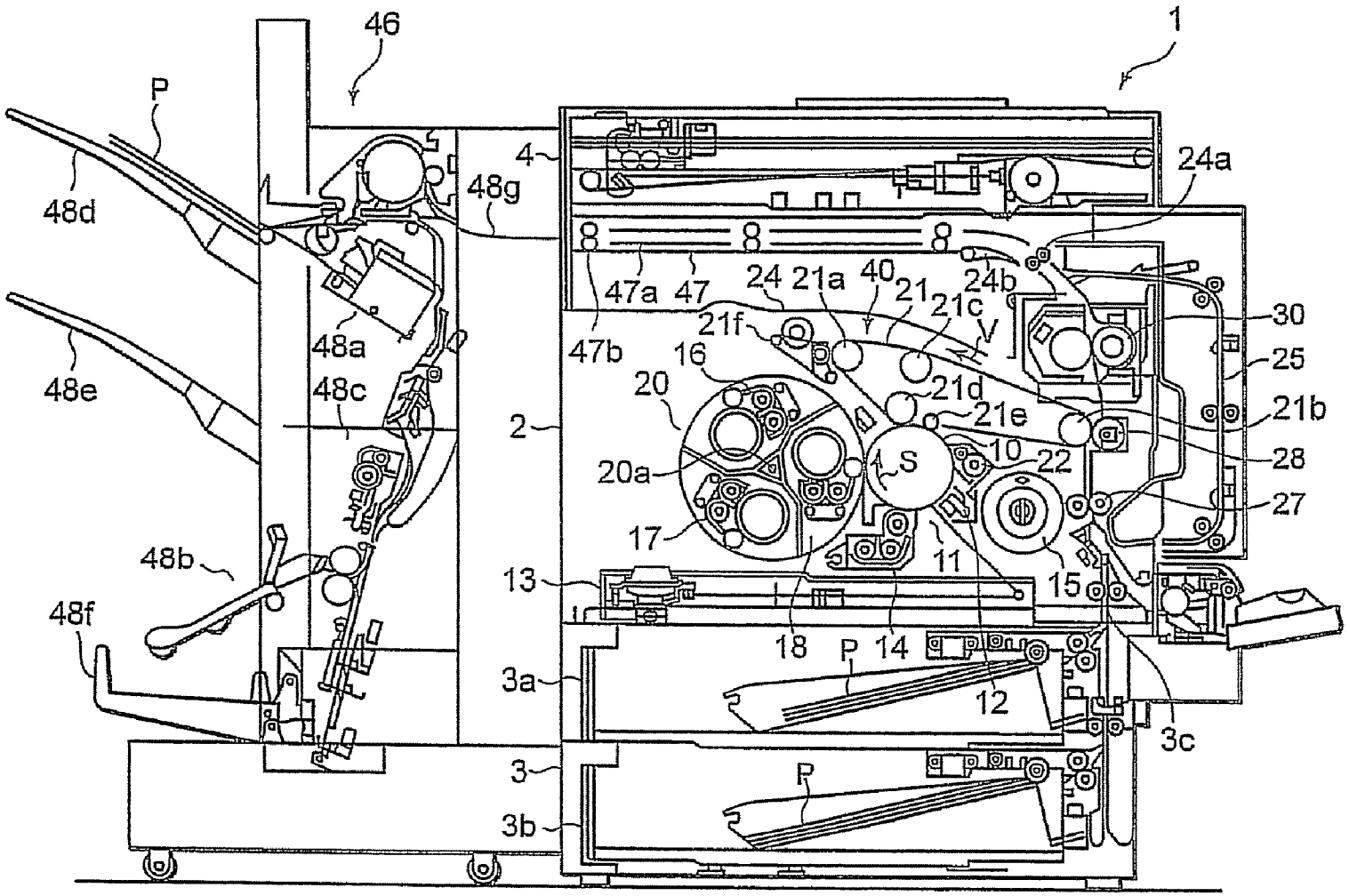
FIG. 1 is a view schematically showing the configuration of a color image forming apparatus incorporating a fixing device according to one embodiment of the invention.

Hereinafter, one embodiment of the invention will be described in detail with reference to the accompanying drawings. FIG. 1 is a view schematically showing the configuration of a color printer apparatus 1, which is a color image forming apparatus incorporating a fixing device according to one embodiment of the invention. A paper feeding device 3 that feeds a sheet of paper P used as a fixed medium in a direction to a printer 2 is provided inside the color printer apparatus 1. The paper feeding device 3 takes out a sheet of paper P from a paper feeding cassette 3*a* or 3*b* and feeds the sheet of paper P in a direction to a resist roller 27 along a transportation path 3*c*. A scanner 4 that reads a document image is provided on the top surface of the color printer apparatus 1.

In the printer 2, a toner image forming portion 11 serving as an image forming member that forms toner images of plural colors on a photoconductive drum 10 serving as an image carrier is provided in the surroundings of the photoconductive drum 10. The toner image forming portion 11 includes a charger device 12 that successively charges the photoconductive drum 10 uniformly along the rotational direction of the photoconductive drum 10 denoted by an arrow indicated by a lower-case s, a laser exposure device that forms an electrostatic latent image on the photoconductive drum 10 having been charged according to image data from the scanner 4, a black developing device 14 which is supplied toner from a toner bottle 15, and a color developing device 20 of a revolver type incorporating a yellow (Y) developing device 16, a magenta (M) developing device 17, and a cyan (C) developing device 18. The color developing device 20 rotates on an axis 20*a*.

A transfer belt device 40 is disposed oppositely to the transfer position in the surroundings of the photoconductive drum 10. The transfer belt device 40 includes a transfer belt 21 serving as a transfer belt member. The transfer belt 21 is pulled across a belt driving roller 21*a*, a driven roller 21*b*, and a tension roller 21*c*. The transfer belt 21 is supported on a primary transfer roller 21*d* that applies primary transfer bias to the transfer belt 21 and an auxiliary roller 21*e* at the position at which it comes into contact with the photoconductive drum 10. Further, a secondary transfer roller 28 to which secondary transfer bias is applied is disposed oppositely to the transfer belt 21 at a secondary transfer position at which it is supported on the driven roller 21*b*. A belt cleaning device 21*f* is provided in the surroundings of the transfer belt 21 at a point after it passes by the secondary transfer position. In addition, a cleaner device 22 is disposed downstream from the transfer belt 21 in the surroundings of the photoconductive drum 10.

The printer 2 includes the secondary transfer roller 28 that secondary transfers toner images of plural colors superimposed on the transfer belt 21 onto a sheet of paper P, a fixing device 30 that fixes the toner images onto the sheet of paper P by heating and pressing while it transports the sheet of paper P by pinching the sheet of paper P using a heat roller 31 serving as a rotating member on the image side and a press roller 32 serving as a rotating member not on the image side, and a paper discharge roller 24*a* that discharges the sheet of paper P to a paper discharge portion 24 after the fixing ends. Further, the printer 2 includes an inversion transportation path 25 used to invert a sheet of paper P when images are formed on the both surfaces.

Moreover, the color printer apparatus 1 can incorporate a finisher 46 as an option. A relay unit 47 is disposed somewhere from the paper discharge roller 24*a* at the top of the paper discharge portion 24 to the finisher 46. The relay unit 47 relays a sheet of paper P discharged to the paper discharge roller 24*a* to the finisher 46. The relay unit 47 includes a relay guide 47*a* and a relay roller 47*b*. Also, the paper discharge portion 24 is provided with a gate mechanism 24*b* that sorts a sheet of paper P discharged from the paper discharge roller 24*a* into the paper discharge portion 27 or the relay guide 47*a*.

The finisher 46 includes a staple unit 48*a*, a saddle stitcher portion 48*b*, an intermediate paper path portion 48*c*, an upper stack tray 48*d*, a lower stack tray 48*e*, and a paper discharge tray 48*f*. A sheet of paper P relayed from the paper discharge roller 24*a* to the relay unit 47 is sent to the finisher 46 via a paper path 48*g*.

Figure 2:
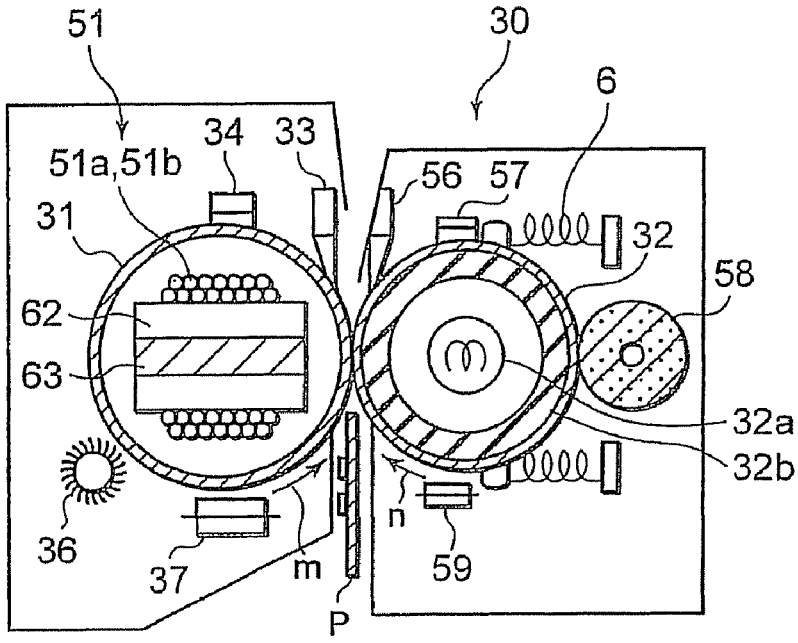
FIG. 2 is a schematic cross section showing the fixing device according to one embodiment of the invention.
Figure 3:
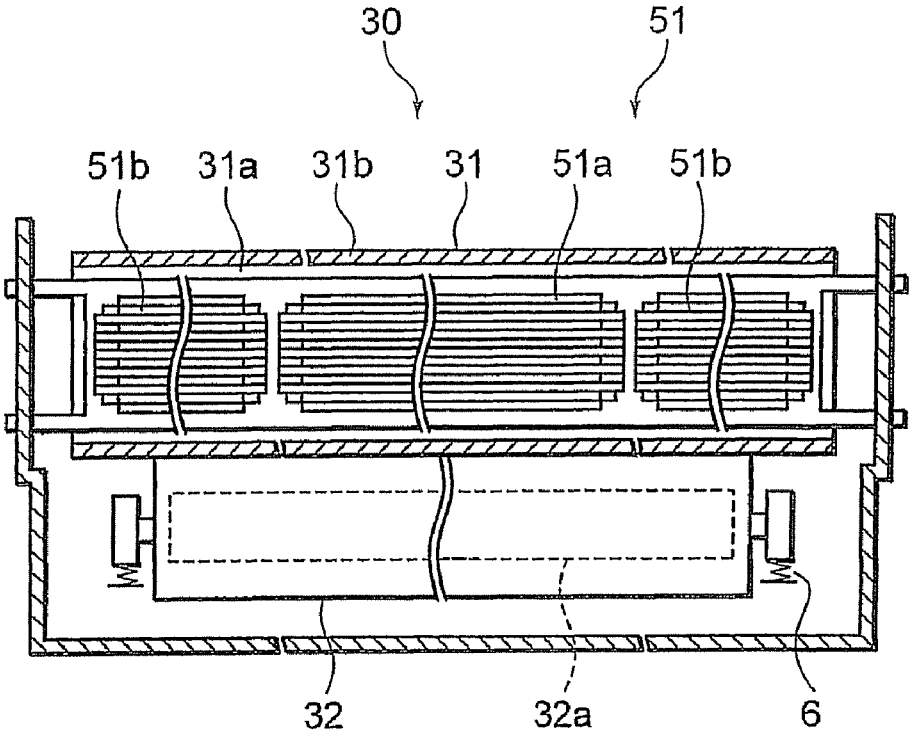
FIG. 3 is a schematic side view showing the fixing device according to one embodiment of the invention.
Figure 4:
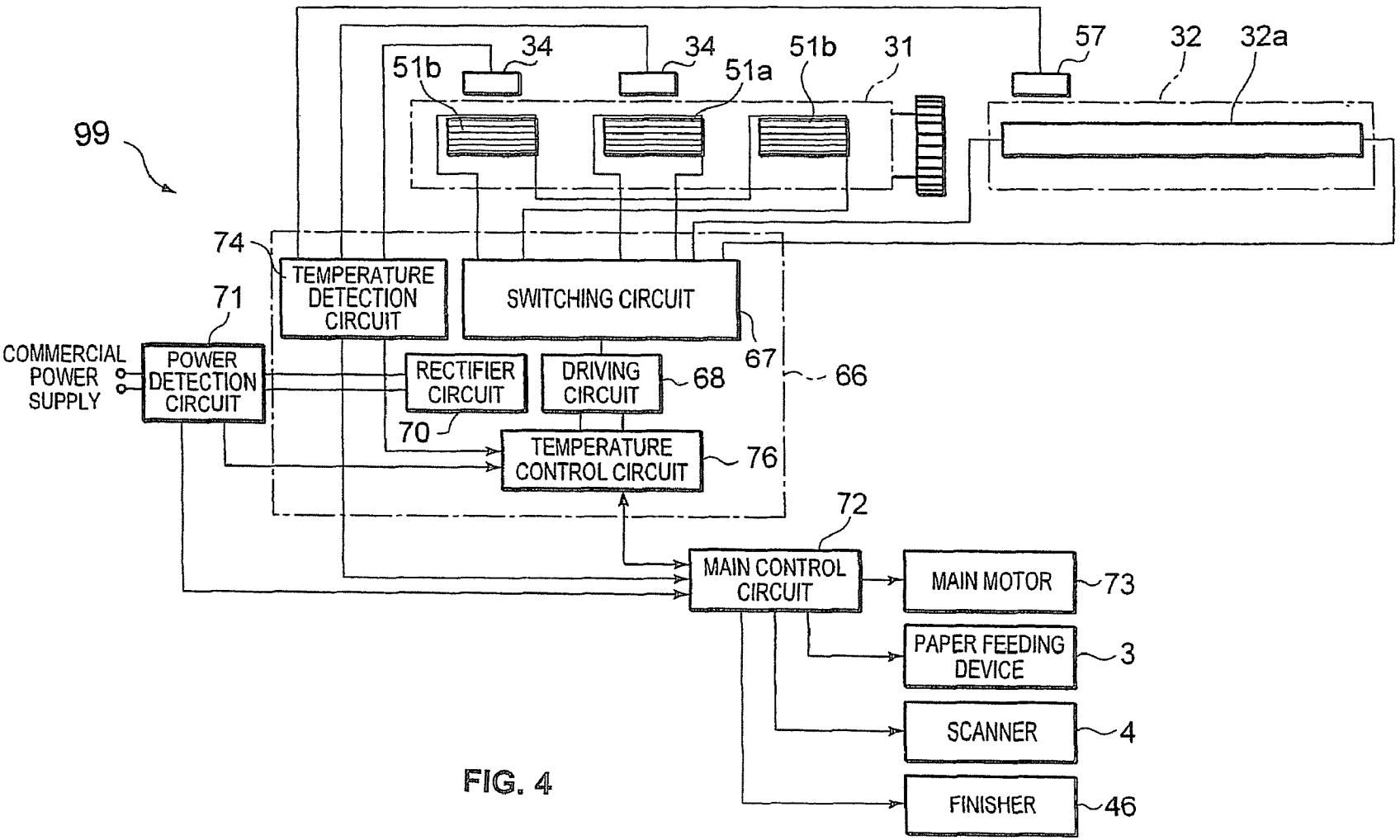
FIG. 4 is a block diagram showing a control system of the fixing device according to one embodiment of the invention.

The fixing device 30 will now be described. FIG. 2 is a view schematically showing the configuration of the fixing device 30 when viewed from the side surface. FIG. 3 is a schematic cross section of the fixing device when viewed in the axial direction of the heat roller 31. FIG. 4 is a block diagram depicting a control system 99 serving as a control portion of the fixing device 30. The heat roller 31 is formed by forming a top coat layer 31*b* on a cored bar 31*a* that is a conductive heat generating layer comprising, for example, a hollow cylinder made of iron, having a thickness of about 0.5 mm. The thickness of the cored bar 31*a* is not particularly limited, and it may be about 1 mm. A material of the cored bar 31*a* is not limited to iron, and stainless steel, nickel, aluminum, alloy of stainless steel and aluminum, etc. can be used as well. The top coat layer 31*b* is made of fluorocarbon resin, such as polytetrafluoroethylene, having a specific thickness. The outside diameter of the heat roller 31 is 40 mm.

The press roller 32 is an elastic roller that houses a heater lamp 32*a* requiring 300 W as an amount of power inside the hollow of an elastic layer 32*b* made of silicon rubber or fluorocarbon rubber. The press roller 32 is almost parallel to the axial line of the heat roller 31, and comes into contact with the heater roller 31 at a specific pressure with respect to the axial line thereof by a pressing mechanism 6. This gives rise to elastic deformation in part of the outer peripheral surface of the press roller 32, which causes a specific nip to be formed between these rollers 31 and 32.

The heat roller 31 is rotated in a direction of an arrow indicated by a lower-case m. The press roller 32 is pressed by the heat roller 31 as it comes into contact with the heat roller 31, and is driven to rotate in a direction indicated by a lower-case n, which is a direction inverse to the direction in which the heat roller 31 is rotated. A separation claw 33 that separates a sheet of paper P having passed by the nip from the heat roller 31 is provided on the periphery of the heat roller 31. In the surroundings of the heat roller 31, a temperature sensor 34, a cleaning member 36, and a heat generation defect sensor 37 are provided downstream from the separation claw 33 along the rotational direction of the heat roller 31.

The temperature sensor 34 comprises a thermistor or the like, and detects the temperature of the outer peripheral surface of the heat roller 31. The cleaning member 36 removes offset toner adhering onto the top coat layer 31*b*, paper dust generated from a sheet of paper P, or a foreign substance that floats in a space inside the apparatus and eventually adheres to the heat roller 31. The cleaning member 36 is made of a material that hardly gives damage to the top coat layer 31*b* when it comes into contact with the heat roller 31, for example, felt or a fur brush. The cleaning member 36 may be rotated as it comes into contact with the surface of the heat roller 31 or it may remain non-rotational and press the outer peripheral surface of the heat roller 31 at a specific pressure.

The heat generation defect sensor 37 comprises a thermistor or the like, and detects a heat generation defect that the surface temperature of the heat roller 31 becomes extremely high. The detection is used to shut down power to be supplied to an exciting coil 51 serving as an induction current generating member when a heat generation defect occurs.

On the periphery of the press roller 32, a separation claw 56 that separates a sheet of paper P from the press roller 32, a temperature sensor 57 comprising a thermistor or the like, a cleaning member 58, and a heat generation defect sensor 59 are provided along the rotational direction of the press roller 32.

The exciting coil 51 is disposed on the inside of the heat roller 31, and induces an eddy-current in the cored bar 31*a*. The exciting coil 51 comprises a first coil 51*a* disposed almost at the center of the heat roller 31 in the longitudinal direction and second coils 51*b* provided near at the both ends. The first coil 51*a* or the second coils 51*b* are formed by winding a specific electric wire (including a stranded wire, such as a litz wire) a certain number of turns. The first coil 51*a* or the second coils 51*b* are set in such a manner that the resistance value reaches the maximum by resonating at their unique resonance frequencies. The first and second coils 51*a* and 51*b* output power by switching alternately, and each is set to be able to output power of 600 to 1300 W. For example, in a case where power of 900 W is supplied to the exciting coil 51, power of 900 W is supplied to the first and second coils 51*a* and 51*b* alternately.

Each of the coils 51*a* and 51*b* is wound around a coil holding body 62. The coil holding body 62 is made of engineering plastic or ceramic having a high heat resistance and high electrical insulation. For example, materials, such as PEEK (polyether ether ketone) and phenol, or unsaturated polyester can be used as the coil holding body 62. Further, a core 63 formed of molded ferrite is provided on the inside of the coil holding body 62.

The core 63 increases magnetic flux density that can be used to cause the heat roller 31 to generate heat. The core 63 uses a dust core or the like that has a smaller loss in a high frequency region as a chief material. The coils 51*a* and 51*b* may be air-core coils using no core materials. The first coil 51*a* is formed in a length to be able to heat, for example, the short side width of an A-4 size sheet of paper (JIS standards).

The exciting coil 51 generates a specific magnetic field when a high frequency output (current and voltage) at a specific frequency is supplied from a temperature control unit 66 in the control system 99 shown in the block diagram of FIG. 4. The temperature control unit 66 includes a switching circuit 67 that is capable of outputting a high frequency to each of the coils 51*a* and 51*b*, and a driving circuit 68 that inputs a specific control signal into the switching circuit 67. Further, the temperature control unit 66 includes a temperature sensor 34 that detects the temperature of the heat roller 31, a temperature detection circuit 74 connected to the temperature sensor 57 that detects the temperature of the press roller 32, and a temperature control circuit 76.

The switching circuit 67 also functions as a switching device capable of setting the individual coils 51*a* and 51*b* to be connected serially or in parallel as desired.

A dc voltage obtained by rectifying an ac voltage from a commercial power supply in a rectifier circuit 70 is supplied to the switching circuit 67 by way of the driving circuit 68. The driving circuit 68 specifies a first frequency f1 to be supplied to the coil 51*a* and a second frequency f2 to be supplied to the coils 51*b* to the switching circuit 67. In other words, the heating strength of the heat roller 31 by the respective coils 51*a* and 51*b* can be set to arbitrary magnitude by changing outputs to be outputted to the respective coils from the switching circuit 67. Also, a heating strength is normally managed in the form of a numerical value as power consumption consumed by the individual coils. The driving circuit 68 supplies power to the heater lamp 32*a* of the press roller 32 by way of the switching circuit 67.

Power supplied to the respective coils 51*a* and 51*b* from the rectifier circuit 70 is constantly monitored, for example, by a power detection circuit 71 provided between the commercial power supply and the input terminal of the rectifier circuit 70. A monitoring result by the power detection circuit 71 is fed back to the driving circuit 68 at certain timing. In order to enable a detection of burning of the driving circuit 68 or the like, an output of the power detection circuit 71 is also inputted into a main control device 72 on the printer 2 side. The main control device 72 controls a main motor 73 of the printer 2, the paper feeding device 3, and the scanner 4. Further, in a case where the finisher 46 is furnished, the main control device 72 controls the finisher 46, too. Power consumption of the main motor 73 of the color printer apparatus 1, the paper feeding device 3, and the scanner 4 is, for example, about 200 W, and power consumption of the finisher 46 is, for example, about 100 W.

In the fixing device 30 of an induction heating type in this embodiment, a high frequency output (current and voltage) at a specific frequency is supplied from the switching circuit 67 to the individual coils 51*a* and 51*b* while the heat roller 31 is heated. In order to prevent a change in a magnetic field induced by a magnetic flux generated from the individual coils 51*a* and 51*b*, an eddy-current is generated in the cored bar 31*a* of the heat roller 31. This increases the temperature of the heat roller 31.

Control on power to be supplied to the exciting coil 51 and the heater lamp 32*a* in the fixing device 30 in a color mode or a monochromatic mode of the color printer apparatus 1 will now be described. As is shown in FIG. 5, in a color mode in which a color toner image comprising plural toners on a sheet of paper P is fixed, the heater lamp 32*a* of the press roller 32 in the fixing device 30 is switched ON. It is therefore possible to supply the exciting coil 51 on the heat roller 31 side with power remaining when 300 W, which is the power consumption of the heater lamp 32*a*, is subtracted from an amount of power that can be supplied to the fixing device 30.

On the other hand, in a monochromatic mode in which, a simple color toner image, for example, a monochromatic toner image, on a sheet of paper P is fixed, the heater lamp 32*a* is normally switched OFF. It should be noted that the heater lamp 32*a* is switched ON when the temperature of the press roller 32 drops. It is therefore possible to supply power with an addition of power comparable to power consumption of the heater lamp 32*a* to the exciting coil 51 on the heat roller 31 side when the heater lamp 32*a* stays OFF in the monochromatic mode. High-speed processing is thus enabled in the monochromatic mode without causing a drop in temperature in the heat roller 31.

An amount of power that can be supplied to the fixing device 30, however, varies with the structure of the color image forming apparatus of each kind. An amount of power that can be supplied to the fixing device 30 is a value obtained by subtracting power consumption needed for various motors, the paper feeding device, the scanner, and the like from a total amount of power that can be supplied to the color image forming apparatus from the commercial power supply. In a case where the color image forming apparatus is furnished with an option mechanism, power consumption needed for the option mechanism is further subtracted from the value obtained above.

For example, assume that 1500 W is a total amount of power that can be supplied to the color image forming apparatus 1 from the commercial power supply, 200 W is power consumption needed for the main motor 73, the paper feeding device 3, the scanner 4, and the like, 100 W is power consumption needed for the finisher 46, and 100 W is power consumption needed for a large-capacity paper feeding device as another option.

Following are examples of an amount of power that can be supplied to the fixing device 30 in a case where the color image forming apparatus 1 is furnished with an option and in a case where the option is not used.

(1) In a Case where the Color Image Forming Apparatus is Fully Furnished with Options (Finisher 46+Large-Capacity Paper Feeding Device)

An amount of power that can be supplied to the fixing device 30 is found to be 1100 W by subtracting 200 W as power consumption needed for the main motor 73, the paper feeding device 3, the scanner 4, and the like and 200 W as power consumption needed for the full options (finisher 46 and large-capacity paper feeding device) from 1500 W, which is a total amount of power from the commercial power supply.

In this instance, in the case of a color mode, because the heater lamp 32*a* of the press roller 32 is switched ON, supply power to the exciting coil 51 of the heat roller 31 is 800 W at a maximum. In the case of a monochromatic mode, the heater lamp 32*a* is kept switched OFF unless a drop in temperature occurs in the press roller 32. In the monochromatic mode, it is therefore possible to supply the exciting coil 51 with 1100 W at a maximum, which is the power with an addition of power comparable to the power consumption of the heater lamp 32*a*. Moreover, an amount of supply power to the exciting coil 51 can be adjusted flexibly as much as needed for the heat roller 31 up to 1100 W at a maximum. In other words, in a case where copies are made continuously at a high speed, the heat roller 31 can be heated instantly by supplying 1100 W at a maximum to the exciting coil 51. This enables a processing speed of as high as 90 cpm in a monochromatic mode without causing the apparatus 1 to go down due to a drop in temperature in the heat roller 31 when no option is connected thereto.

Further, because no option is driven during a warm-up, an amount of power that can be supplied to the fixing device 30 is found to be 1300 W by subtracting 200 W as power consumption needed for the main motor 73, the paper feeding device 3, the scanner 4, and the like from 1500 W, which is a total amount of power from the commercial power supply. During a warm-up, it is therefore possible to supply the exciting coil 51 with 1000 W, which is a remainder when 300 W to be supplied to the heater lamp 32*a* of the press roller 32 is further subtracted. This shortens the warm-up time.

(2) In a Case where the Color Image Forming Apparatus 1 is Furnished with No Options An amount of power that can be supplied to the fixing device 30 is found to be 1300 W by subtracting 200 W, which is required as power consumption needed for the main motor 73, the paper feeding device 3, the scanner 4, and the like, from 1500 W, which is a total amount of power from the commercial power supply.

In this instance, in a color mode, because the heater lamp 32*a* of the press roller 32 is switched ON, supply power to the exciting coil 51 of the heat roller 31 is assumed to be 1000 W at a maximum. In a monochromatic mode, the heater lamp 32*a* is kept switched OFF unless a drop in temperature occurs in the press roller 32. In a monochromic mode, it is therefore possible to supply the exciting coil 51 with 1300 W at a maximum, which is power with an addition of power comparable to the power consumption of the heater lamp 32*a*. In addition, an amount of supply power to the exciting coil 51 can be adjusted flexibly as much as needed for the heat roller 31 up to 1300 W at a maximum. This enables a processing speed of 90 cpm at a maximum in a monochromatic mode without causing the apparatus 1 to go down due to a drop in temperature in the heat roller 31 when no option is connected thereto.

During a warm-up, as with the color printer apparatus 1 furnished with the option (s), it is possible to supply 300 W to the heater lamp 32*a* of the press roller 32 and 1000 W to the exciting coil 51.

In other words, as has been described above, the exciting coil 51 is able to obtain an amount of power as much as it needs regardless of the presence or absence of the option(s) or the copy modes, which makes it easier to control the fixing device 30.

Figure 6:
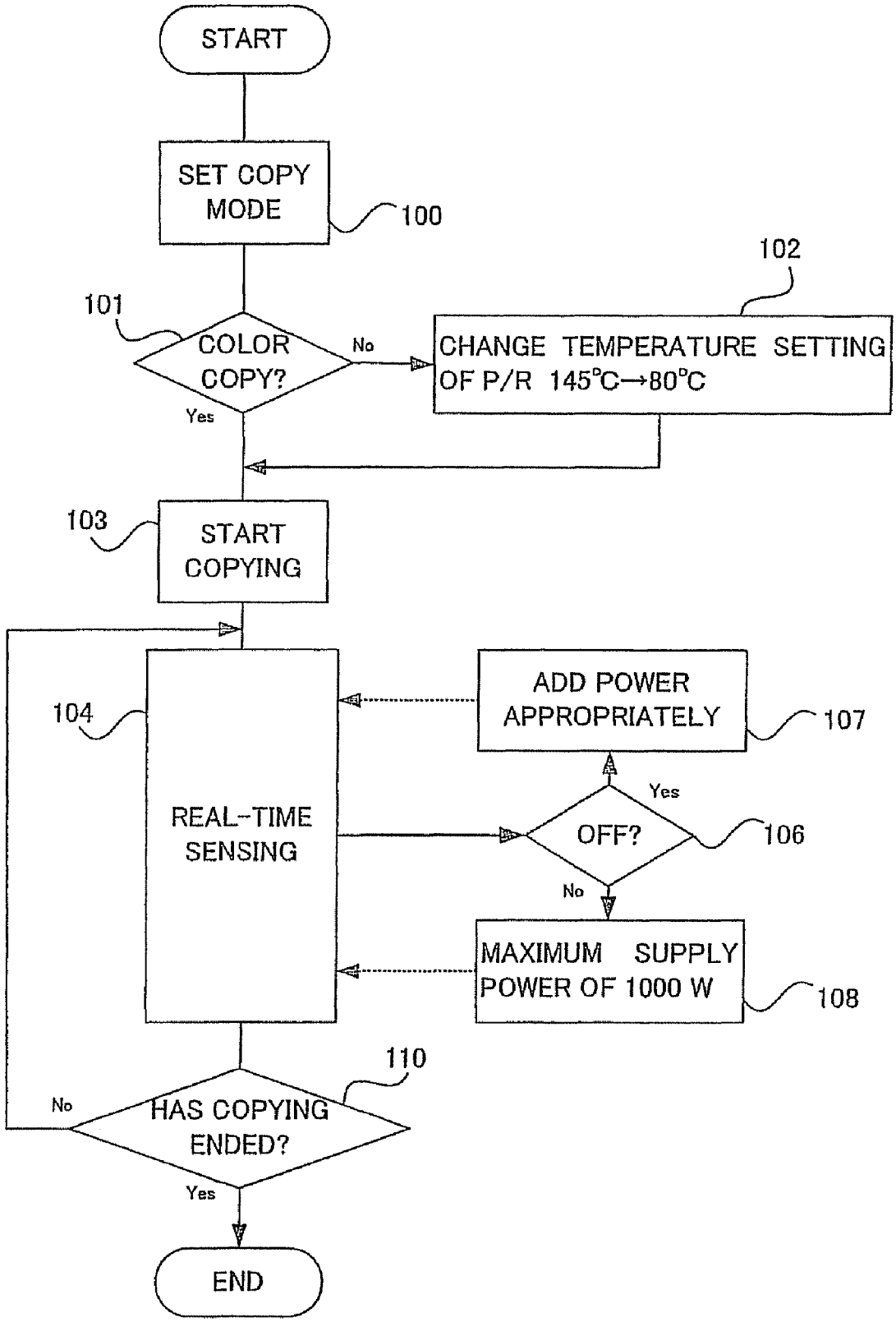
FIG. 6 is a flowchart detailing a setting process of the fixing device according to one embodiment of the invention.

The setting process of the fixing device will now be described with reference to the flowchart shown in FIG. 6. In a case where the color printer apparatus 1 is not furnished with the finisher 46, it is possible to supply 1300 W at a maximum to the fixing device 30 as power. For the structure furnished with the finisher 46 or any other option, an amount of power that can be supplied to the fixing device 30 for the color printer apparatus 1 is a remainder when power consumption needed for the option(s) is further subtracted from 1300 W at a maximum. The maximum power that can be supplied to the fixing device 30 has been set previously when the color printer apparatus 1 is installed.

The setting process of the fixing device 30 for the color printer apparatus 1 furnished with the finisher 46 will now be described with the use of FIG. 6. In a case where the apparatus 1 is not furnished with the option(s), such as the finisher 46, only the difference when it is furnished with the option(s) is the maximum power that can be supplied to the fixing device 30, and the description of this difference is omitted. Instead, a table for power control alone is shown in FIG. 9.

In this embodiment, assume that the color printer apparatus 1 is set in such a manner that a color mode is chosen as the copy mode in the initial settings. In a case where the color printer apparatus 1 is in the color mode, the temperature setting of the press roller 32 is 145° C. In the case of the color mode, the heater lamp 32*a* of the press roller 32 is switched ON, and 600 W is supplied to the exciting coil 51 of the heat roller 31 as power.

Next, in a case where a monochromatic mode is needed for the initial settings, the copy mode is set in Step 100. In subsequent Step 101, whether the copy mode of the color printer apparatus 1 is a color mode is checked by comparison. In the case of the color mode, color copying is started in Step 103.

In the case of the monochromatic mode, the temperature setting of the press roller 32 is changed from 145° C. to 80° C. in Step 102. Also, the heater lamp 32*a* of the press roller 32 is switched ON only when the temperature of the press roller 32 drops to 80° C. Copying is then started in Step 103. Thereafter, in Step 104, real-time sensing of the temperatures of the heat roller 31 and the press roller 32 and the ON/OFF state of the heater lamp 32*a* is performed depending on whether the copy mode is the color or monochromic mode.

In Step 104, whether the heater lamp 32*a* is switched ON/OFF is further checked by comparison (Step 106). When the heater lamp 32*a* is switched OFF (in the monochromic mode), supply power is supplied to the exciting coil 51 by adding power appropriately (Step 107). The supply power that can be added for the exciting coil 51 is up to 300 W at a maximum, which is an amount of supply power to the heater lamp 32*a*. When the heater lamp 32*a* is switched ON, the maximum supply power to the exciting coil 51 of the heat roller 31 is limited to 1000 W (Step 108).

When all the copying operations end in Step 110 by making copies while the fixing device 30 is adjusted as has been described, the copy process is terminated. When the copying has not been completed in Step 110, the flow returns to Step 104 to obtain a specific amount of copies.

Figure 7:
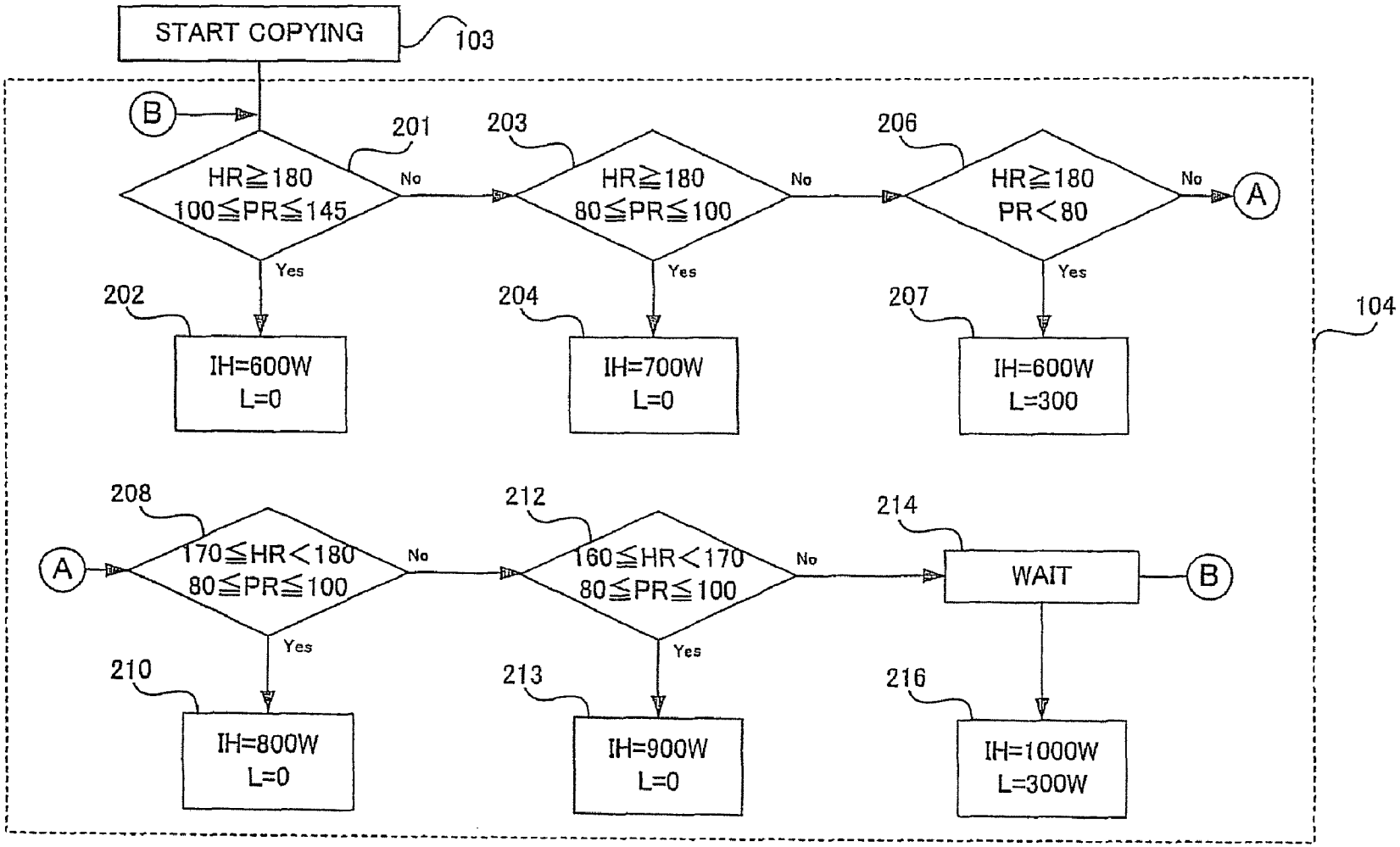
FIG. 7 is a flowchart detailing real-time sensing in the setting process of the fixing device according to one embodiment of the invention.

The real-time sensing in Step 104 will now be described in detail with reference to FIG. 7. In the real-time sensing, the ON/OFF control on the heater lamp (abbreviated as L) 32*a* and supply power to the exciting coil (abbreviated as IH) 51 are set in response to detected temperatures of the heat roller (abbreviated as HR) 31 and the press roller (abbreviated as PR) 32. More specifically, whether HR≧180° C. and 100° C.≦PR≦145° C. are checked by comparison (Step 201). In the case of Yes, IH=600 W and L=0 are set (Step 202).

In the case of No, whether HR≧180° C. and 80° C.≦PR≦145° C. are checked by comparison (Step 203). In the case of Yes, IH=700 W and L=0 are set (Step 204). In the case of No, whether HR≧180° C. and PR<80° C. are checked by comparison (Step 206). In the case of Yes, IH=600 W and L=300 W are set (Step 207). In the case of No, whether 170° C.≦HR<180° C. and 80° C.≦PR<100° C. are checked by comparison (Step 208). In the case of Yes, IH=800 W and L=0 are set (Step 210). In the case of No, whether 160° C.≦HR<170° C. and 80° C.≦PR<100° C. are checked by comparison (Step 212). In the case of Yes, IH=900 W and L=0 are set (Step 213). In the case of No, the state shifts to a wait state, and the copying is suspended (Step 214). When the copying is resumed, a warm-up is performed by setting IH=1000 W and L=300 W (Step 216).

In short, as is shown in FIG. 8, the heater lamp 32*a* operating on 300 W is controlled to be switched ON in the color mode. It is therefore possible to heat the bottom layer of the color toner image sufficiently, and satisfactory fixing can be achieved at a fixing speed of 45 cpm. In the monochromatic mode, 900 W at a maximum is supplied to the exciting coil 51 as power in response to the detected temperature of the heat roller 31 when the heater lamp 32*a* stays OFF. It is therefore possible to prevent the fixing speed from becoming lower due to a drop in temperature of the heat roller 31, and satisfactory fixing can be achieved even when the fixing speed is as high as 90 cpm. Further, during a warm-up, because the finisher 46 is not activated, it is possible to supply about 1300 W to the fixing device 30 as power. Hence, even when 300 W is supplied to the heater lamp 32*a*, power up to 1000 W at a maximum can be supplied to the exciting coil 51. As a consequence, the warm-up time can be shortened.

According to this embodiment, the cored bar 31*a* of the heat roller 31 generates heat using the exciting coil 51 as the fixing device 30 for the color printer apparatus 1. This enables the lower side of a color toner image having a thick toner layer to be heated sufficiently, which can in turn enhance the fixing performance. In the monochromatic mode, an amount of power supplied to the heater lamp 32*a* of the press roller 32 can be added to power for the exciting coil 51 flexibly as much as an amount needed for the heat roller 31. Hence, even when copies are made continuously in the monochromatic mode, the heat roller 31 can be heated sufficiently so that a drop in temperature of the fixing device 30 can be prevented, which can in turn enhance the fixing productivity. Further, during a warm-up, an amount of power to be supplied to the option is added to the power for the exciting coil 51. The warm-up time can be therefore shortened.

It should be appreciated that the invention is not limited to the embodiment above, and the invention can be modified in various manners without deviating from the scope of the invention. For example, the rotating member on the image side or the rotating member not on the image side is not limited to a roller, and it may be an endless belt or the like. The magnitude of power consumption of the heat source of the rotating member not on the image side, the driving mechanism of the color image forming apparatus, the magnitude of power consumption of the scanner, and the like can be set arbitrarily to suit the structures of the apparatus of various types. In addition, the fixing speed of the color image forming apparatus is not limited, either. Moreover, a case where power is added for the induction current generating member by reducing power consumption of the heat source is not limited to the case of a monochromatic toner, and it may be a case where an image of two colors or the like is fixed.

What is claimed is:

1. A fixing device for a color image forming apparatus, comprising:

a first roller that heats a medium bearing a toner image;

a first heater that causes a heat on the first roller;

a second roller that pinches the medium together with the first roller;

a second heater that causes a heat on the second roller; and a control unit configured to control the first heater to cause a heat on the first roller in a color mode and a monochromatic mode, to control the second heater to cause a heat on the second roller in the color mode, to control the second heater to halt to cause a heat on the second roller when a temperature of the first roller is a first temperature or higher and a temperature of the second roller is a second temperature or higher in the monochromatic mode, and to control the second heater to cause a heat on the second roller when the temperature of the second roller is lower than the second temperature in the monochromatic mode.

2. The device of claim 1, wherein the control unit controls the first heater to increase the heat when the temperature of the first roller is lower than the first temperature.

3. The device of claim 1, wherein the first roller comprises a conductive heat generating layer.

4. The device of claim 3, wherein the first heater is an induction current generator that causes the heat generating layer to induce an induction current.

5. The device of claim 4, wherein the second heater is a lamp.

6. An image forming apparatus comprising:

an image forming member that forms a toner image on a medium in color in a color mode and in monochrome in a monochrome mode;

a first roller that heats the medium bearing the toner image;

a first heater that causes a heat on the first roller;

a second roller that pinches the medium together with the first roller;

a second heater that causes a heat on the second roller; and a control unit configured to control the first heater to cause a heat on the first roller in the color mode and the monochromatic mode, to control the second heater to cause a heat on the second roller in the color mode, to control the second heater to halt to cause a heat on the second roller when a temperature of the first roller is a first temperature or higher and a temperature of the second roller is a second temperature or higher in the monochromatic mode, and to control the second heater to cause a heat on the second roller when the temperature of the second roller is lower than the second temperature in the monochromatic mode.

7. The apparatus of claim 6, wherein the control unit controls the first heater to increase the heat when the temperature of the first roller is lower than the first temperature.

8. The apparatus of claim 6, wherein the first roller comprises a conductive heat generating layer.

9. The apparatus of claim 8, wherein the first heater is an induction current generator that causes the heat generating layer to induce an induction current.

10. The apparatus of claim 9, wherein the second heater is a lamp.

11. The apparatus of claim 6, wherein the image forming member comprises a black developing device, a yellow developing device, a magenta developing device and a cyan developing device.

12. An image forming method for an apparatus comprising a first roller that heats a medium bearing a toner image, a first heater that causes a heat on the first roller, a second roller that pinches the medium together with the first roller and a second heater that causes a heat on the second roller, comprising:

forming the toner image on the medium in color in a color mode and in monochrome in a monochrome mode; and controlling the first heater to cause a heat on the first roller in a color mode and a monochromatic mode, the second heater to cause a heat on the second roller in the color mode, the second heater to halt to cause a heat on the second roller when a temperature of the first roller is a first temperature or higher and a temperature of the second roller is a second temperature or higher in the monochromatic mode, and the second heater to cause a heat on the second roller when the temperature of the second roller is lower than the second temperature in the monochromatic mode.

13. The method of claim 12, further comprising controlling the first heater to increase the heat when the temperature of the first roller is lower than the first temperature.

14. The method of claim 12, wherein the first roller comprises a conductive heat generating layer.

15. The method of claim 14, wherein the first heater is an induction current generator that causes the heat generating layer to induce an induction current.

16. The method of claim 15, wherein the second heater is a lamp.

17. The method of claim 12, wherein the image forming member comprises a black developing device, a yellow developing device, a magenta developing device and a cyan developing device.

* * * * *